US009630423B2

(12) United States Patent
Vella et al.

(10) Patent No.: US 9,630,423 B2
(45) Date of Patent: Apr. 25, 2017

(54) HYDROPHILIC IMAGING MEMBER SURFACE MATERIAL FOR VARIABLE DATA INK-BASED DIGITAL PRINTING SYSTEMS AND METHODS FOR MANUFACTURING HYDROPHILIC IMAGING MEMBER SURFACE MATERIALS

(71) Applicant: XEROX CORPORATION, Norwalk, CT (US)

(72) Inventors: Sarah J. Vella, Milton (CA); Carolyn Moorlag, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 193 days.

(21) Appl. No.: 14/028,330

(22) Filed: Sep. 16, 2013

(65) Prior Publication Data

US 2015/0077500 A1 Mar. 19, 2015

(51) Int. Cl.

| | |
|---|---|
| ***B41J 2/435*** | (2006.01) |
| ***B05D 3/14*** | (2006.01) |
| ***G03G 13/28*** | (2006.01) |
| ***B41C 1/10*** | (2006.01) |
| ***B41M 1/06*** | (2006.01) |
| ***B41N 1/00*** | (2006.01) |
| ***G03G 7/00*** | (2006.01) |
| *B41M 5/00* | (2006.01) |
| *B41N 3/08* | (2006.01) |

(52) U.S. Cl.

CPC ..... *B41J 2/435* (2013.01); *B05D 3/148* (2013.01); *B41C 1/1066* (2013.01); *B41M 1/06* (2013.01); *B41N 1/003* (2013.01); *G03G 7/0046* (2013.01); *G03G 13/283* (2013.01); *B05D 2506/10* (2013.01); *B41M 5/0047* (2013.01); *B41N 3/08* (2013.01)

(58) Field of Classification Search

CPC B41J 2/435; B05D 3/14; G03G 15/01; G03G 13/283

See application file for complete search history.

(56) References Cited

U.S. PATENT DOCUMENTS

| | | | | |
|---|---|---|---|---|
| 2007/0019997 | A1* | 1/2007 | Lior | G03G 15/161 399/302 |
| 2008/0090004 | A1* | 4/2008 | Zhang | C09D 4/00 427/180 |
| 2012/0103212 | A1* | 5/2012 | Stowe et al. | 101/147 |
| 2013/0104756 | A1 | 5/2013 | Stowe et al. | |

* cited by examiner

*Primary Examiner* — Sarah Al Hashimi
(74) *Attorney, Agent, or Firm* — Prass LLP

(57) ABSTRACT

An ink-based digital printing system suitable for use with hydrophilic and/or aqueous dampening fluids includes an imaging member having an imaging member material that is hydrophilic at the imaging surface.

16 Claims, 2 Drawing Sheets

HYDROPHILIC IMAGING MEMBER SURFACE MATERIAL FOR VARIABLE DATA INK-BASED DIGITAL PRINTING SYSTEMS AND METHODS FOR MANUFACTURING HYDROPHILIC IMAGING MEMBER SURFACE MATERIALS

FIELD OF DISCLOSURE

The disclosure relates to imaging member surface materials useful for variable data ink-based digital printing. In particular, the disclosure relates to a hydrophilic material useful for forming an imaging member surface.

BACKGROUND

Ink-based digital printing systems include an imaging member having an imaging surface such as a plate or blanket. The imaging surface must meet a range of requirements to enable high speed variable data ink-based digital printing. In related art systems, for example, the imaging surface must be configured for wetting the surface with dampening fluid, and pinning the dampening fluid thereon. The imaging surface must be configured for absorbing optical radiation from a laser imaging system, wetting and pinning of ink subsequently applied to the imaging member surface, and release of the ink from the surface.

The dampening fluid prevents ink from transferring to the plate at non-printing areas, or background or non-image areas. The printing areas are areas on the imaging member surface on which dampening fluid is volatilized after exposing the applied dampening fluid layer to radiation. The non-printing areas are areas on the imaging member surface on which dampening fluid remains, being outside the zones of exposure to radiation. Exemplary imaging member surface materials that have been found to be useful for ink-based digital printing include hydrophobic polymers such as silicones, partially or fully fluorinated fluorosilicones and FKM fluoroelastomers. Exemplary dampening fluids that have been found to be compatible for wetting the above-mentioned imaging member surface materials and suitable for ink-based digital printing include hydrophobic fluids such as hydrocarbons, fluorocarbons, fluoroethers, organosiloxanes, fluoro-organosiloxanes. Concerns about using these hydrophobic fluids relate to the containment and capture of volatilized fluids that may not be vented into the environment, or precluded from remaining in significant amounts on the printed matter. Water is a desirable dampening fluid for offset printing because it is inexpensive, and environmentally friendly, and therefore does not require volatilized fluid recapture or monitoring of hydrophobic fluids on the prints.

SUMMARY

Hydrophilic materials found to be suitable for forming imaging members for ink-based digital printing would enable the use of water or other hydrophilic materials and/or aqueous solutions to be used as dampening fluid materials. Improved plate materials are desired for enabling cost-effective, high quality, high speed ink-based digital printing. An imaging member surface or plate material, methods of forming the same, and digital offset printing systems are provided that include a hydrophilic plate material. The hydrophilic plate material enables use of hydrophilic or polar dampening fluids or fountain solutions such as water, ethylene glycol, or aqueous solutions. In accordance with methods of embodiments, a hydrophilic surface may be generated directly from hydrophobic materials by plasma oxidation. Accordingly, a plate surface may be formed that is rewritable; the oxidized surface is temporary. Alternatively, the plate may be rendered permanently hydrophilic by post-oxidation modification. Post-oxidation modification may include, but is not limited to, covalently linking a polar or charged molecule to the freshly oxidized surface to permanently render the surface hydrophilic.

In an embodiment, imaging members for ink-based digital printing may include an imaging member surface comprising a hydrophilic imaging surface.

In an embodiment, ink-based digital printing systems may include an imaging member, the imaging member having a hydrophilic imaging member surface; a dampening fluid metering system for applying a layer of dampening fluid to the imaging member surface; a laser imaging system for dampening fluid patterning; and an inking system for applying ink to the imaging member surface having patterned dampening fluid disposed thereon.

In an embodiment, methods for forming an imaging member for ink-based digital printing with polar or hydrophilic dampening fluid may include transforming a hydrophobic imaging member surface material to a hydrophilic imaging member surface material by oxidizing the hydrophobic surface material.

Exemplary embodiments are described herein. It is envisioned, however, that any system that incorporates features of systems described herein are encompassed by the scope and spirit of the exemplary embodiments.

DETAILED DESCRIPTION

Exemplary embodiments are intended to cover all alternatives, modifications, and equivalents as may be included within the spirit and scope of the apparatus and systems as described herein.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value.

Reference is made to the drawings to accommodate understanding of systems for ink-based digital printing using a system having an imaging member for which imaging member surface materials and methods of forming the same are useful.

"Variable data lithography printing," or "ink-based digital printing," or "digital offset printing" is lithographic printing of variable image data for producing images on a substrate that are changeable with each subsequent rendering of an image on the substrate in an image forming process. "Variable data lithographic printing" includes offset printing of ink images using lithographic ink wherein the images are based on digital image data than may vary from image to image. Ink-based digital printing uses a variable data lithography printing system, or digital offset printing system. A "variable data lithography system" is a system that is configured for lithographic printing using lithographic inks and based on digital image data, which may be variable from one image to the next.

Such systems are disclosed in U.S. patent application Ser. No. 13/095,714 ("714 Application"), titled "Variable Data Lithography System," filed on Apr. 27, 2011, by Stowe et al., the disclosure of which is hereby incorporated by reference herein in its entirety. The systems and methods disclosed in the 714 Application are directed to improvements on various aspects of previously-attempted variable data imaging lithographic marking concepts based on variable patterning of dampening fluids to achieve effective truly variable digital data lithographic printing.

Figure 1:
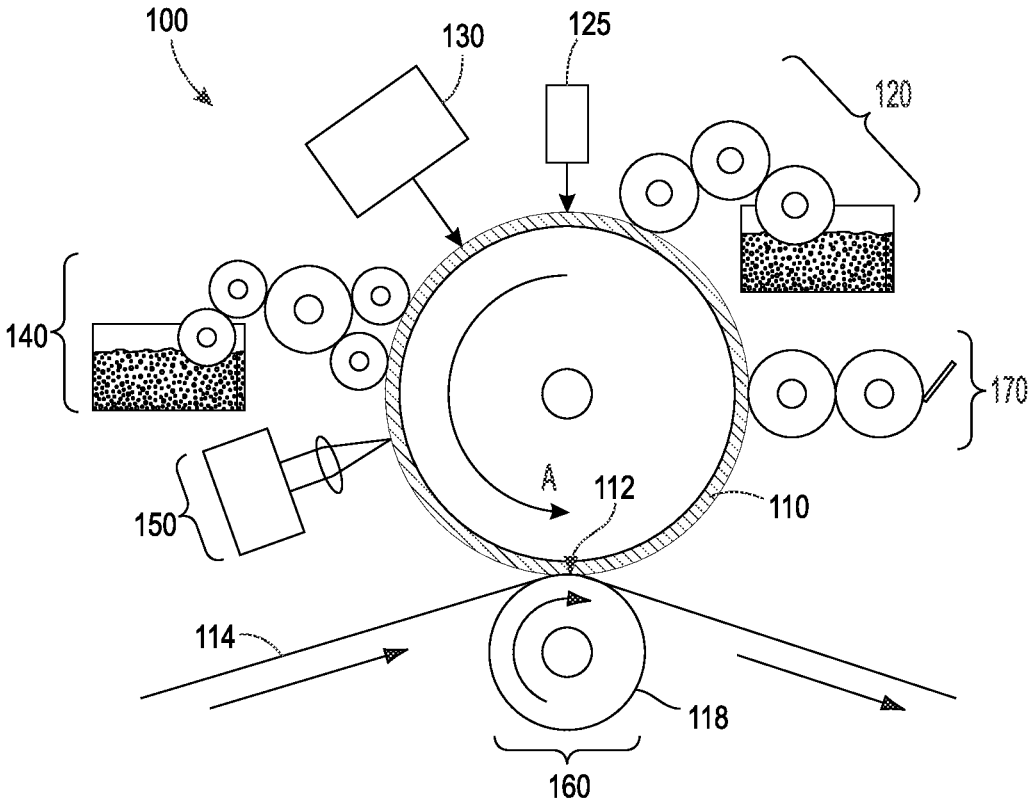
FIG. 1 RELATED ART
FIG. 1 shows a side diagrammatical view of a related art ink-based digital printing system.

The 714 Application describes an exemplary variable data lithography system 100 for ink-based digital printing, such as that shown, for example, in FIG. 1. A general description of the exemplary system 100 shown in FIG. 1 is provided here. Additional details regarding individual components and/or subsystems shown in the exemplary system 100 of FIG. 1 may be found in the 714 Application.

As shown in FIG. 1, the exemplary system 100 may include an imaging member 110. The imaging member 110 in the embodiment shown in FIG. 1 is a drum, but this exemplary depiction should not be interpreted so as to exclude embodiments wherein the imaging member 110 includes a drum, plate or a belt, or another now known or later developed configuration.

The imaging member 110 is used to apply an ink image to an image receiving media substrate 114 at a transfer nip 112. The transfer nip 112 is formed by an impression roller 118, as part of an image transfer mechanism 160, exerting pressure in the direction of the imaging member 110. Image receiving medium substrate 114 should not be considered to be limited to any particular composition such as, for example, paper, plastic, or composite sheet film. The exemplary system 100 may be used for producing images on a wide variety of image receiving media substrates. The 714 Application also explains the wide latitude of marking (printing) materials that may be used, including marking materials with pigment densities greater than 10% by weight. As does the 714 Application, this disclosure will use the term ink to refer to a broad range of printing or marking materials to include those which are commonly understood to be inks, pigments, and other materials which may be applied by the exemplary system 100 to produce an output image on the image receiving media substrate 114.

The 714 Application depicts and describes details of the imaging member 110 including the imaging member 110 being comprised of a reimageable surface layer formed over a structural mounting layer that may be, for example, a cylindrical core, or one or more structural layers over a cylindrical core.

The system 100 includes a dampening fluid system 120 generally comprising a series of rollers, which may be considered as dampening rollers or a dampening unit, for uniformly wetting the reimageable surface of the imaging member 110 with dampening fluid. A purpose of the dampening fluid system 120 is to deliver a layer of dampening fluid, generally having a uniform and controlled thickness, to the reimageable surface of the imaging member 110. The dampening fluid system 120 may comprise a system configured for metering of dampening fluid by anilox, vapor deposition, or any other process now known or later developed for applying a thin layer of dampening fluid.

As indicated above, it is known that a dampening fluid such as fountain solution may comprise mainly water optionally with small amounts of isopropyl alcohol or ethanol added to reduce surface tension as well as to lower evaporation energy necessary to support subsequent laser patterning, as will be described in greater detail below. Small amounts of certain surfactants may be added to the fountain solution as well. Alternatively, other suitable dampening fluids may be used to enhance the performance of ink based digital lithography systems. Exemplary dampening fluids include water, Novec 7600 (1,1,1,2,3,3-Hexafluoro-4-(1,1,2,3,3,3-hexafluoropropoxyl)pentane and has CAS#870778-34-0.), and D4 (octamethylcyclotetrasiloxane). Other suitable dampening fluids are disclosed, by way of example, in co-pending U.S. patent application Ser. No. 13/284,114, filed on Oct. 28, 2011, titled "Dampening Fluid For Digital Lithographic Printing," the disclosure of which is hereby incorporated herein by reference in its entirety.

Once the dampening fluid is metered onto the reimageable surface of the imaging member 110, a thickness of the dampening fluid may be measured using a sensor 125 that may provide feedback to control the metering of the dampening fluid onto the reimageable surface of the imaging member 110 by the dampening fluid system 120.

After a precise and uniform amount of dampening fluid is provided by the dampening fluid system 120 on the reimageable surface of the imaging member 110, and optical patterning subsystem 130 may be used to selectively form a latent image in the uniform dampening fluid layer by imagewise patterning the dampening fluid layer using, for example, laser energy. Typically, the dampening fluid will not absorb the optical energy (IR or visible) efficiently. The reimageable surface of the imaging member 110 should ideally absorb most of the laser energy (visible or invisible such as IR) emitted from the optical patterning subsystem 130 close to the surface to minimize energy wasted in heating the dampening fluid and to minimize lateral spreading of heat in order to maintain a high spatial resolution capability. Alternatively, an appropriate radiation sensitive component may be added to the dampening fluid to aid in the absorption of the incident radiant laser energy. While the optical patterning subsystem 130 is described above as being a laser emitter, it should be understood that a variety of different systems may be used to deliver the optical energy to pattern the dampening fluid.

The mechanics at work in the patterning process undertaken by the optical patterning subsystem 130 of the exemplary system 100 are described in detail with reference to FIG. 5 in the 714 Application. Briefly, the application of optical patterning energy from the optical patterning subsystem 130 results in selective removal of portions of the layer of dampening fluid.

Following patterning of the dampening fluid layer by the optical patterning subsystem 130, the patterned layer over the reimageable surface of the imaging member 110 is presented to an inker subsystem 140. The inker subsystem 140 is used to apply a uniform layer of ink over the layer of dampening fluid and the reimageable surface layer of the imaging member 110. The inker subsystem 140 may use an anilox roller to meter an offset lithographic ink onto one or more ink forming rollers that are in contact with the reimageable surface layer of the imaging member 110. Separately, the inker subsystem 140 may include other traditional elements such as a series of metering rollers to provide a precise feed rate of ink to the reimageable surface. The inker subsystem 140 may deposit the ink to the pockets representing the imaged portions of the reimageable surface, while ink on the unformatted portions of the dampening fluid will not adhere to those portions.

The cohesiveness and viscosity of the ink residing in the reimageable layer of the imaging member 110 may be modified by a number of mechanisms. One such mechanism may involve the use of a rheology (complex viscoelastic modulus) control subsystem 150. The rheology control system 150 may form a partial crosslinking core of the ink on the reimageable surface to, for example, increase ink cohesive strength relative to the reimageable surface layer. Curing mechanisms may include optical or photo curing, heat curing, drying, or various forms of chemical curing. Cooling may be used to modify rheology as well via multiple physical cooling mechanisms, as well as via chemical cooling.

The ink is then transferred from the reimageable surface of the imaging member 110 to a substrate of image receiving medium 114 using a transfer subsystem 160. The transfer occurs as the substrate 114 is passed through a nip 112 between the imaging member 110 and an impression roller 118 such that the ink within the voids of the reimageable surface of the imaging member 110 is brought into physical contact with the substrate 114. With the adhesion of the ink having been modified by the rheology control system 150, modified adhesion of the ink causes the ink to adhere to the substrate 114 and to separate from the reimageable surface of the imaging member 110. Careful control of the temperature and pressure conditions at the transfer nip 112 may allow transfer efficiencies for the ink from the reimageable surface of the imaging member 110 to the substrate 114 to exceed 95%. While it is possible that some dampening fluid may also wet substrate 114, the volume of such a dampening fluid will be minimal, and will rapidly evaporate or be absorbed by the substrate 114.

In certain offset lithographic systems, it should be recognized that an offset roller, not shown in FIG. 1, may first receive the ink image pattern and then transfer the ink image pattern to a substrate according to a known indirect transfer method.

Following the transfer of the majority of the ink to the substrate 114, any residual ink and/or residual dampening fluid must be removed from the reimageable surface of the imaging member 110, preferably without scraping or wearing that surface. An air knife may be employed to remove residual dampening fluid. It is anticipated, however, that some amount of ink residue may remain. Removal of such remaining ink residue may be accomplished through use of some form of cleaning subsystem 170. The 714 Application describes details of such a cleaning subsystem 170 including at least a first cleaning member such as a sticky or tacky member in physical contact with the reimageable surface of the imaging member 110, the sticky or tacky member removing residual ink and any remaining small amounts of surfactant compounds from the dampening fluid of the reimageable surface of the imaging member 110. The sticky or tacky member may then be brought into contact with a smooth roller to which residual ink may be transferred from the sticky or tacky member, the ink being subsequently stripped from the smooth roller by, for example, a doctor blade.

The 714 Application details other mechanisms by which cleaning of the reimageable surface of the imaging member 110 may be facilitated. Regardless of the cleaning mechanism, however, cleaning of the residual ink and dampening fluid from the reimageable surface of the imaging member 110 is essential to preventing ghosting in the proposed system. Once cleaned, the reimageable surface of the imaging member 110 is again presented to the dampening fluid system 120 by which a fresh layer of dampening fluid is supplied to the reimageable surface of the imaging member 110, and the process is repeated.

The imaging member reimageable surface may comprise a polymeric elastomer, such as silicone rubber, and/or fluorosilicone rubber, polydimethylsiloxane (PDMS), among others. The reimageable surface may be formed of a relatively thin layer over a mounting layer, a thickness of the relatively thin layer being selected to balance printing or marking performance, durability and manufacturability.

The term "silicone" is well understood in the art and refers to polyorganosiloxanes having a backbone formed from silicon and oxygen atoms, and side chains containing carbon and hydrogen atoms. For the purposes of this application, the term "silicone" should also be understood to exclude siloxanes that contain fluorine atoms, while the term "fluorosilicone" is used to cover the class of siloxanes that contain fluorine atoms. Other atoms may be present in the silicone rubber, for example nitrogen atoms in amine groups which are used to link siloxane chains together during crosslinking. The side chains of the polyorganosiloxane can also be alkyl or aryl.

The term "alkyl" as used herein refers to a group composed entirely of carbon atoms and hydrogen atoms that is fully saturated. The alkyl group may include a chain that is linear, branched, or cyclic. For example, linear alkyl radicals generally have the formula $—C_nH_{2n+1}$.

The term "aryl" refers to an aromatic group composed entirely of carbon atoms and hydrogen atoms. When aryl is described in connection with a numerical range of carbon atoms, it should not be construed as including substituted aromatic radicals.

Imaging member surfaces and ink-based digital printing systems in accordance with embodiments include a hydrophilic imaging member surface material that enables use of water or aqueous fountain solution, for example, in the digital offset printing process. In particular, an ink-based digital printing system in accordance with an embodiment comprises a hydrophilic imaging surface. Any suitable hydrophilic composition may be used to form the imaging member surface in accordance with embodiments. For example, polymers of hydrophilic character may include synthetic rubbers such as polyether-ester elastomers, polyurethanes, polyurethane-polyethers, and copolymer mixtures. Oxygen plasma oxidation of PDMS, or poly(vinylmethyl)siloxane (PVMS), may be carried out to yield a hydrophilic surface. Crosslinkable silicone surfaces such as PVMS may be reacted with reactable components containing a range of hydrophilic functionalities including amines, hydroxides, ethers, ions, acids, or salts, in order to render the surface hydrophilic. In a preferred embodiment, oxidized PDMS is used to form an imaging member surface that is hydrophilic.

Methods in accordance with embodiments may include forming an imaging member surface material by producing hydrophilic groups on the surface portions of organic polymers that form an imaging member surface material, such as a surface of an imaging plate as shown in FIG. 1. For example, oxidation of PDMS produces hydrophilic silicone dioxide and silanol groups at the surface portions of the polymers.

A hydrophilic imaging member or plate material enables use of water, ethylene glycol, or other aqueous solutions as a dampening fluid or fountain solution. Water and ethylene glycol, for example, are inexpensive, readily available, and environmentally favorable options for dampening fluid. Aqueous dampening fluids configured for offset printing are commercially available and particular designed for use with offset inks. Water has a heat of vaporization (e.g., 40.65 kJ/mol) comparable to that of suitable non-aqueous dampening fluid, for example, octamethylcyclotetrasiloxane (44 kJ/mol). In accordance with embodiments, hydrophobic imaging member surface material may be converted to a hydrophilic surface material by way of plasma oxidation, for example.

By way of example, PDMS or dimethicone is a mineral-organic polymer (a structure containing carbon, silicon and oxygen) of the siloxane family, and the components for forming cross-linked PDMS are readily available. The chemical formula for PDMS is $CH_3[Si(CH_3)_2O]_nSi(CH_3)_3$, where n is the number of repeating monomer $SiO(CH_3)_2]$ units. PDMS has the following structural formula:

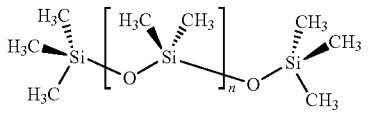

After cross-linking, PDMS becomes a hydrophobic elastomer. When polar solvents such as water are used to wet a surface formed of cross-linked PDMS, the solvent tends to bead and does not spread, making the water ineffective as a dampening fluid for blocking ink. Plasma may be used to oxidize PDMS thereby changing the surface chemistry of PDMS to produce silanol terminations and/or silicon dioxide terminations that cause the surface to be hydrophilic. Plasma oxidation thus makes the PDMS surface, and material surfaces formed of PDMS amenable to wetting with hydrophilic solutions or solvents. Atmospheric air plasma and argon plasma are typically used for plasma oxidation. In embodiments, plasma-oxidized, cross-linked PDMS may have exposed or surface groups including, but not limited to, silicon dioxide, silanol groups, carboxylic acids and/or hydroxyl groups.

EXAMPLES

Cross-linked PDMS was made using a commercially available (Dow Corning Corporation), two component system; the two components, the base and the curing agent, were mixed in a 10 to 1 ratio, respectively. Oxidation of the PDMS surface was achieved using a Harrick Plasma Cleaner/Sterilizer (model PDC-32G).

Contact angle (CA) measurements verified the switch from a hydrophobic surface to a hydrophilic surface upon plasma oxidation of the PDMS for 10 seconds. A contact angle is the angle at which a liquid interface meets a solid interface. The contact angle is a criterion of surface hydrophobicity, and may be used to determine wettability of a surface. Contact angle measurements are shown in Table 1.

TABLE 1

| CA Measurements | | |
|---|---|---|
| | Water CA | Literature Water CA |
| Non treated PDMS | ~109.4° ± 0.4° | 110.2° ± 2.3°[1] |
| Plasma treated PDMS | <30° | 30.1° ± 1.9°[1] |

[1]Anal. Chem., 2006, 78, 21, 7446

Plasma oxidation of fluoroelastomer and fluorosilicone also produced hydrophilic surfaces which were wetted by water and ethylene glycol.

Ink-based digital printing systems were characterized using hand roller print tests. The test consisted of placing a stripe of dampening fluid on an imaging plate using a cotton tipped stick, inking a hand roller with ink, and rolling the ink onto the imaging plate. The ink was then transferred from the plate to paper with a second, clean roller used to apply pressure to the back of the paper in contact with the plate. The tests were implemented for testing an ability of the plate material to wet with hydrophilic dampening fluids and yield non-imaging areas where the dampening fluid was applied. Successive transfers following the initial transfer were implemented in order to characterize the transfer efficiency of ink transferred from plate to paper.

Results were produced from the hand rolled print test using a polyester acrylate UV curable ink of a composition which would be used for offset printing and is known to those familiar in the art. Plate materials tested included a) unoxidized PDMS silicone and b) oxidized PDMS silicone. Dampening fluids tested included (a) water; b) ethylene glycol (EG); and c) octamethylcyclotetrasiloxane. Results indicated that octamethylcyclotetrasiloxane functions yields non-imaging areas of the UV-curable ink well on the unoxidized (hydrophobic) silicone plate. A drawback of using octamethylcyclotetrasiloxane on silicone is the plate-dampening fluid interaction that results in change in dimension of the plate material. When used as a dampening fluid, water does not wet the surface of the unoxidized silicone, and therefore cannot act as for imaging in the presence of UV curable ink. Further, ethylene glycol did not wet the surface of the unoxidized silicone plate and did not function for imaging in the presence of UV curable ink. When the silicone plate is oxidized by plasma treatment, octamethylcyclotetrasiloxane, water, and ethylene glycol wet the surface and imaging of the surface may be effectively carried out with the application of UV curable ink. Mixtures of ethylene glycol and water (50:50, bp~110° C.; 90:10, bp~145° C.) also effectively wetted plasma oxidized silicone; the 90:10 mixture was very effective at blocking the ink.

Results were produced from a hand rolled print test polyester acrylate UV curable ink with oxidized silicone plates and dampening fluids comprising a) water; b) ethylene glycol; and c) a 2% SILSURF aqueous solution obtained from Siltech Corporation. Each of the three dampening fluids, water, ethylene glycol, and 2% SILSURF aqueous solution wet the oxidized silicone plate. The 2% SILSURF aqueous solution and ethylene were found to be particularly effective at imaging UV curable ink without the presence of background in non-imaging areas.

Results from the hand rolled print test using polyester acrylate UV curable ink on fluorosilicone were produced using the following plate materials: a) unoxidizied fluorosilicone and b) oxidized fluorosilicone. The dampening fluids comprised: a) water; and b) oxidized fluorosilicone with 2% SILSURF aqueous solution. It was found that water does not wet unoxidized fluorosilicone surface and does not function to image the applied ink layer. It was found that water wets oxidized fluorosilicone and partially images ink. The 2% SILSURF aqueous solution was found to wet oxidized fluorosilicone and function to yield an image with the application of the applied ink layer.

Imaging member surface materials and methods for producing such materials in accordance with embodiments are useful for forming digital offset printing plates, for example, that enable use of polar or hydrophilic dampening fluids. It has been found that hydrophilic imaging member surface material facilitates sufficient wetting of the imaging member surface or plate with ink and polar fountain solutions.

Imaging member surfaces in accordance with embodiments comprise a hydrophilic plate material, which may be formed from inexpensive, commercially available, and robust material. Such plates may be used with polar fountain solutions that are inexpensive and environmentally friendly, such as water, glycols such as ethylene glycol, alcohols, or aqueous surfactant solutions.

Figure 2:
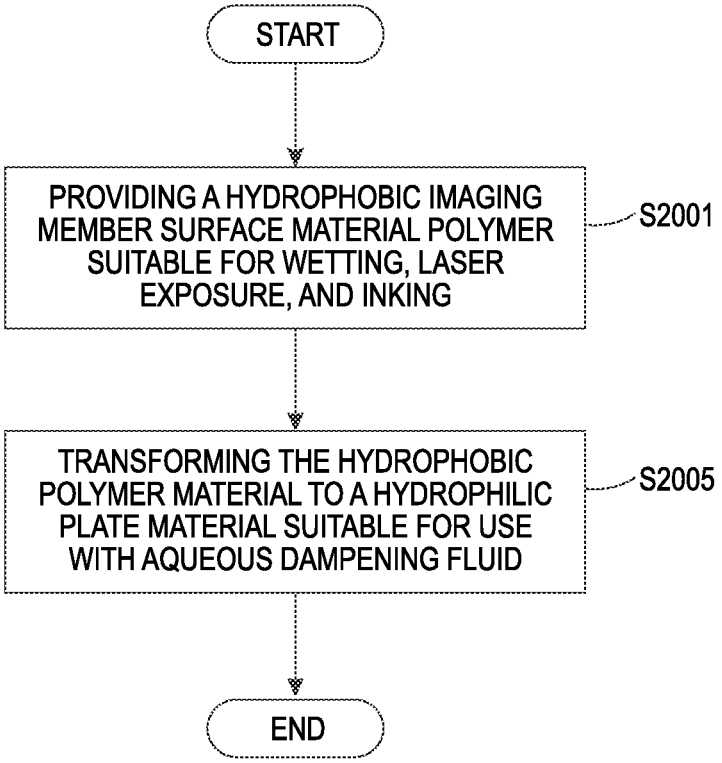
FIG. 2 shows methods of forming an imaging member surface in accordance with an exemplary embodiment.

Methods for forming an imaging member having a hydrophilic surface may include transforming a hydrophobic imaging member surface to a hydrophilic imaging member surface. For example, FIG. 2 shows a method for forming a hydrophilic imaging member that includes providing at S2001 a hydrophobic imaging member surface material polymer suitable for wetting, laser exposure, and inking. For example, the material may be silicone that is formed to constitute an imaging member surface. Alternatively, the material may be an alkyl or aryl polymer, fluorosilicone, or fluoroelastomer for example.

Methods may include transforming the hydrophobic polymer material to a hydrophilic plate material suitable for use with aqueous dampening fluid at S2005. For example, methods may include treating the material provided at S2001 by plasma oxidation to form hydrophilic terminal groups on the surface of the material polymer. In methods, the transformation may be made permanent by covalently linking a polar or charged molecule to the surface of the polymer.

It will be appreciated that the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. An imaging member for ink-based digital printing, comprising:

an imaging member surface comprising a hydrophilic reimageable switchable imaging surface, the hydrophilic imaging member surface including plasma oxidized cross-linked PDMS, the plasma oxidized cross-linked PDMS imaging member surface configured in a hydrophilic state switched for a temporary period from a hydrophobic state via a plasma treatment, the plasma oxidized cross-linked PDMS imaging member surface configured to return from the hydrophilic state to the hydrophobic state after the temporary period;

wherein the imaging member surface further comprises a fluoroelastomer copolymer, where two or more monomers of the fluoroelastomer copolymer are selected from the group consisting of hexafluoropropylene (HFP), tetrafluoroethylene (TFE), vinylidene fluoride (VDF), perfluoromethyl vinyl ether (PMVE), and ethylene (ET), wherein a fluorine content of the fluoroelastomer copolymer lies in a range of about 60 wt% to about 70 wt%.

2. The imaging member of claim 1, the imaging member surface further comprising a cross-linked silicone polymer with hydrophilic groups at a surface of the polymer that renders the surface of the cross-linked silicone hydrophilic.

3. The imaging member of claim 2, the imaging member surface further comprising cross-linked PDMS with covalently attached polar or charged molecules.

4. The imaging member of claim 1, the plasma oxidized cross-linked PDMS imaging member surface being in the temporary hydrophilic state switched from the hydrophobic state via the plasma treatment for 10 seconds.

5. The imaging member of claim 1, the imaging member surface further comprising fluorosilicone.

6. The imaging member of claim 1, wherein at least one of the two or more monomers of the fluoroelastomer copolymer is vinylidene fluoride (VDF).

7. The imaging member of claim 1, wherein the plasma oxidized cross-linked PDMS has a water contact angle equal to or less than 32 degrees.

8. An ink-based digital printing system, comprising:

an imaging member, the imaging member having a hydrophilic reimageable switchable imaging member surface including plasma oxidized cross-linked PDMS, the plasma oxidized cross-linked PDMS imaging member surface configured in a hydrophilic state switched for a temporary period from a hydrophobic state via a plasma treatment, the plasma oxidized cross-linked PDMS imaging member surface configured to return from the hydrophilic state to the hydrophobic state after the temporary period, wherein the imaging member surface further comprises a fluoroelastomer copolymer, where two or more monomers of the fluoroelastomer copolymer are selected from the group consisting of hexafluoropropylene (HFP), tetrafluoroethylene (TFE), vinylidene fluoride (VDF), perfluoromethyl vinyl ether (PMVE), and ethylene (ET), wherein a fluorine content of the fluoroelastomer copolymer lies in a range of about 60 wt% to about 70 wt%;

a dampening fluid metering system for applying a layer of dampening fluid to the imaging member surface;

a laser imaging system for dampening fluid patterning; and an inking system for applying ink to the imaging member surface having patterned dampening fluid disposed thereon.

9. The system of claim 8, the imaging member surface material further comprising plasma-oxidized, cross-linked PDMS having exposed groups selected from the group comprising silicon dioxide, silanol groups, carboxylic acids and/or hydroxyl groups.

10. The system of claim 8, the imaging member surface material further comprising chemically modified hydrophilic fluorosilicone.

11. The system of claim 8, the imaging member surface material further comprising chemically modified hydrophilic fluoroelastomer.

12. The system of claim 8, the imaging member surface material further comprising a polymer of hydrophilic character, the polymer being selected from the group comprising polyether-ester elastomers, polyurethanes, polyurethane-polyethers, and copolymer mixtures.

13. The system of claim 8, the imaging member surface material further comprising plasma-oxidized cross-linked PVMS.

14. The system of claim 8, wherein at least one of the two or more monomers of the fluoroelastomer copolymer is vinylidene fluoride (VDF).

15. The system of claim 8, wherein the plasma oxidized cross-linked PDMS has a water contact angle equal to or less than 32 degrees.

16. The system of claim 8, the plasma oxidized cross-linked PDMS imaging member surface being in the temporary hydrophilic state switched from the hydrophobic state via the plasma treatment for 10 seconds.

* * * * *